US009109394B2

(12) United States Patent
Hernandez

(10) Patent No.: US 9,109,394 B2
(45) Date of Patent: Aug. 18, 2015

(54) ADJUSTABLE LADDER SUPPORT MECHANISM

(71) Applicant: Pablo Hernandez, Tampa, FL (US)

(72) Inventor: Pablo Hernandez, Tampa, FL (US)

( * ) Notice: Subject to any disclaimer, the term of this patent is extended or adjusted under 35 U.S.C. 154(b) by 0 days.

(21) Appl. No.: 13/905,589

(22) Filed: May 30, 2013

(65) Prior Publication Data

US 2013/0319794 A1 Dec. 5, 2013

Related U.S. Application Data

(60) Provisional application No. 61/654,291, filed on Jun. 1, 2012.

(51) Int. Cl.

| | |
|---|---|
| ***E04C 1/00*** | (2006.01) |
| ***E04C 5/00*** | (2006.01) |
| ***E06C 5/02*** | (2006.01) |
| ***E06C 7/00*** | (2006.01) |
| ***E06C 5/04*** | (2006.01) |
| *E06C 1/397* | (2006.01) |
| *E06C 5/20* | (2006.01) |

(52) U.S. Cl.

CPC ... *E06C 5/02* (2013.01); *E06C 5/04* (2013.01); *E06C 7/00* (2013.01); *E06C 1/397* (2013.01); *E06C 5/20* (2013.01)

(58) Field of Classification Search

CPC ..... E06C 5/00; E06C 5/02; E06C 5/04; E06C 5/06; E06C 7/00; E06C 7/42

USPC ..... 182/63.1, 64.1, 68.1, 127, 180.2, 180.3

See application file for complete search history.

(56) References Cited

U.S. PATENT DOCUMENTS

| | | | | | |
|---|---|---|---|---|---|
| 141,126 | A | | 7/1873 | Eagon | |
| 237,616 | A | * | 2/1881 | Sherwood, Jr | 182/17 |
| 362,609 | A | * | 5/1887 | Clator | 182/68.1 |
| 444,878 | A | * | 1/1891 | De Loria | 182/67.1 |
| 657,932 | A | | 9/1900 | Gardner | |
| 719,364 | A | * | 1/1903 | Pettis | 182/68.2 |
| 1,162,413 | A | * | 11/1915 | Sperling | 182/68.1 |
| 2,186,119 | A | * | 1/1940 | Moen | 182/17 |
| 2,777,737 | A | * | 1/1957 | Balogh | 182/1 |
| 2,829,814 | A | * | 4/1958 | Warner | 182/17 |
| 2,969,123 | A | | 1/1959 | Jamerson | |
| 3,007,540 | A | * | 11/1961 | Reinhardt | 182/27 |
| 3,472,337 | A | * | 10/1969 | Atchey | 182/2.7 |
| 3,515,243 | A | * | 6/1970 | Ellen, Jr | 182/68.1 |
| 3,612,218 | A | * | 10/1971 | Blair et al. | 182/127 |
| 3,767,007 | A | * | 10/1973 | Garnett | 182/2.5 |

(Continued)

OTHER PUBLICATIONS

Equip-Ar, Escalera sobre Trailer para Transporte.

*Primary Examiner* — Katherine Mitchell
*Assistant Examiner* — Shiref Mekhaeil
(74) *Attorney, Agent, or Firm* — Larson & Larson, P.A.; Justin P. Miller; Patrick A. Reid

(57) ABSTRACT

The disclosed adjustable ladder support mechanism solves the problem of unstable extension ladders with a mobile base that can be moved by one man, the base then expanded in both length and width. With the stable base set up, the ladder can be extended, the angle adjusted, and the operator can safely climb the ladder. Worries of the ladder slipping sideways off the ledge against which it is leaned are eliminated.

The adjustable ladder support mechanism has two main sections: the base, which provides stability, and the tower, which raises the ladder above the ground.

14 Claims, 5 Drawing Sheets

(56) References Cited

U.S. PATENT DOCUMENTS

| | | | | | |
|---|---|---|---|---|---|
| 3,882,964 | A | * | 5/1975 | Schellenberg | 182/69.4 |
| 3,894,613 | A | * | 7/1975 | Elizondo | 182/43 |
| 3,999,628 | A | * | 12/1976 | Parson | 182/46 |
| 4,540,095 | A | * | 9/1985 | Wormser et al. | 212/299 |
| 4,676,713 | A | * | 6/1987 | Voelpel | 414/590 |
| 4,684,314 | A | * | 8/1987 | Luth | 414/746.1 |
| 4,834,215 | A | * | 5/1989 | Smeal | 182/66.2 |
| 5,076,448 | A | * | 12/1991 | Ballard | 212/294 |
| 5,295,555 | A | * | 3/1994 | Strange | 182/2.5 |
| 5,297,653 | A | * | 3/1994 | Wurtz et al. | 182/69.5 |
| 5,441,126 | A | * | 8/1995 | Orrick | 182/106 |
| 5,584,646 | A | * | 12/1996 | Lewis et al. | 414/738 |
| 5,857,544 | A | * | 1/1999 | Del Sole | 182/180.3 |
| 6,053,284 | A | * | 4/2000 | Fountain | 182/180.2 |
| 6,378,655 | B1 | * | 4/2002 | Campbell | 182/169 |
| 6,467,576 | B2 | * | 10/2002 | Figura et al. | 182/63.1 |
| 6,598,702 | B1 | * | 7/2003 | McGillewie et al. | 182/2.6 |
| 6,641,146 | B2 | * | 11/2003 | Reese | 280/32.6 |
| 7,635,249 | B2 | * | 12/2009 | Guidroz | 414/746.1 |
| 7,753,169 | B1 | | 7/2010 | Kurtz | |
| 8,042,651 | B1 | | 10/2011 | Michnik et al. | |
| 2006/0169536 | A1 | * | 8/2006 | Davis | 182/127 |

* cited by examiner

ADJUSTABLE LADDER SUPPORT MECHANISM

CROSS-REFERENCE TO RELATED APPLICATION

This application is a non-provisional application that claims priority to U.S. provisional patent application Ser. No. 61/654,291, filed Jun. 1, 2012, the disclosure of which is hereby incorporated by reference.

FIELD

This invention relates to the field of ladders and more particularly to an adjustable mechanism for supporting a ladder, such as an extension ladder.

BACKGROUND

Ladders of various sizes, shapes, and uses are well known in the art. But for a professional who needs to perform many different elevated tasks, often many different ladders are required. A professional may need an A-frame ladder (step ladder) for free-standing work, an extension ladder for very high work, and a platform ladder for horizontal elevated work. It is inconvenient and expensive to store and transport this many ladders.

What is needed is a ladder system that provides adjustability and versatility to allow many uses of a single ladder.

SUMMARY

Elevated work often requires the use of an extension ladder. But the unsteady nature of extension ladders makes such work hazardous. A-frame ladders, while more stable, are unavailable in heights above twenty feet. Thus, higher work necessitates either scaffolding or an extension ladder. The disclosed adjustable ladder support mechanism solves the problem of unstable extension ladders with a mobile base that can be moved by one man, the base then expanded in both length and width. With the stable base set up, the ladder can be extended, the angle adjusted, and the operator can safely climb the ladder. Worries of the ladder slipping sideways off the ledge against which it is leaned are eliminated.

The adjustable ladder support mechanism has two main sections: the base, which provides stability, and the tower, which raises the ladder above the ground.

The Base

The base provides the platform for the adjustable ladder support mechanism. The footprint, or area of the supporting surface (e.g., ground, driveway, etc.) covered by the base, is supported at each corner by wheels. The footprint is expandable through movable outriggers, or movement of the supporting wheels themselves.

Each corner of the base moves outward to increase size of the footprint, and thus stability. Depending upon the embodiment, this expansion can be performed manually or by use of a powered system. If manually, it may be through a hand-cranked screw mechanism, if automated, through any type of linear actuator (e.g., mechanical actuators, hydraulic actuators, pneumatic actuators, piezoelectric actuators, electro-mechanical actuators).

The base allows for expansion through the use of sliding joints. The example embodiment uses nested box beams, one sliding into another, to allow for expansion/contraction of the base.

The wheels present at the corners are either mounted on a horizontal axle for rotation in a single direction, or allowing for spinning, such as is seen in casters.

The Tower

The tower rises from the base, substantially forming a shape resembling a capital letter "A." A first set of legs of the tower is of a fixed length in the embodiment shown. The second set of legs can either be of a fixed length, or of an adjustable length. Adjustable length allows the legs to expand or collapse, changing the height and position of the peak of the tower.

In alternative embodiments, the first set of legs is also of variable length.

In an embodiment with legs of adjustable length, the sets of legs that make up the tower are hingedly attached to the base. The hinged connections can be of any type, although simple barrel hinges or pivot hinges are shown in the embodiment.

The sets of legs optionally include steps, allowing an operator to climb the steps of the adjustable ladder support mechanism to reach the extension ladder mounted at the peak of the tower.

Ladder Gripping Mechanism

At the peak of the tower is the ladder gripping mechanism, where the adjustable ladder support mechanism attaches to an extension ladder. The extension ladder used need not be a specific type, although the dimensions of the ladder gripping mechanism may need to be adjusted for unusually sized extension ladders.

The base section, or larger section, of the extension ladder is held by the ladder gripping mechanism. The fly section, or smaller section, is free to extend from the base mechanism.

The fly section of ladder is held in place relative to the base section of the ladder by rung locks, as are common in extension ladders.

The ladder gripping mechanism is hingedly attached to the tower. A linear actuator of any type (e.g., mechanical actuators, hydraulic actuators, pneumatic actuators, piezoelectric actuators, electro-mechanical actuators) is used to change the angle of the ladder gripping mechanism, and thus the angle of the ladder.

The ladder is held within the ladder gripping mechanism by a pin that passes through the ladder gripping mechanism itself and into a hole created in the extension ladder by the penetration of a ladder rung.

The chain drive is used to move the extension ladder through the ladder gripping mechanism. In order to use the chain drive the proximal end of the chain is affixed to the proximal end of the base section of the extension ladder. The ladder pin is pulled to release the base section of the extension ladder, and then the crank is turned to pull the proximal end of the chain, raising the ladder. When the ladder is in the desired location the ladder pin is reinserted.

Extension Ladder

As discussed, for most embodiments the extension ladder is separate. A standard extension ladder consists of a base section that generally rests on the ground, and a fly section that extends from the top of the ladder. Extension is often performed by attaching one end of a cord to a rung near the bottom of the fly section of the ladder, and running the cord through a pulley near the top of the base section of the ladder. Pulling the cord results in the fly section of the ladder being pulled upward. Once the fly section of the ladder is at its desired location, rung locks are used to lock the two sections of the ladder relative to one another.

Furthermore, optional ladder plates may be used to affix the base section and the fly section of the ladder together.

Ladder Rung Platform

The adjustable ladder support mechanism can also be used as a type of scaffolding. By lowering the angle of the ladder gripping mechanism to an angle near horizontal, and adjusting the length of the tower legs if needed, the extension ladder is used in a horizontal position and acts as a work platform.

But using a ladder in a horizontal position may result in the user stepping into the spaces between the rungs.

Folding Rung Covers

The adjustable ladder support mechanism optionally includes folding covers that provide a platform over the extension ladder. The folding rung covers are intended for use when the extension ladder is in a near-horizontal position and the spaces between the rungs are a danger, rather than a location for one's foot.

The folding rung covers are of any number of plates, connected to the extension ladder by hinges. The exemplary folding rung covers are comprised of two plates per cover, with a total of two covers being sufficient to fill the width of the extension ladder.

The folding rung covers are anticipated to use tracks integrated with the rungs that guide the folding rung covers from open to closed positions.

The folding rung covers are of sufficient strength to allow a user to walk on them.

Option handrails are also shown.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
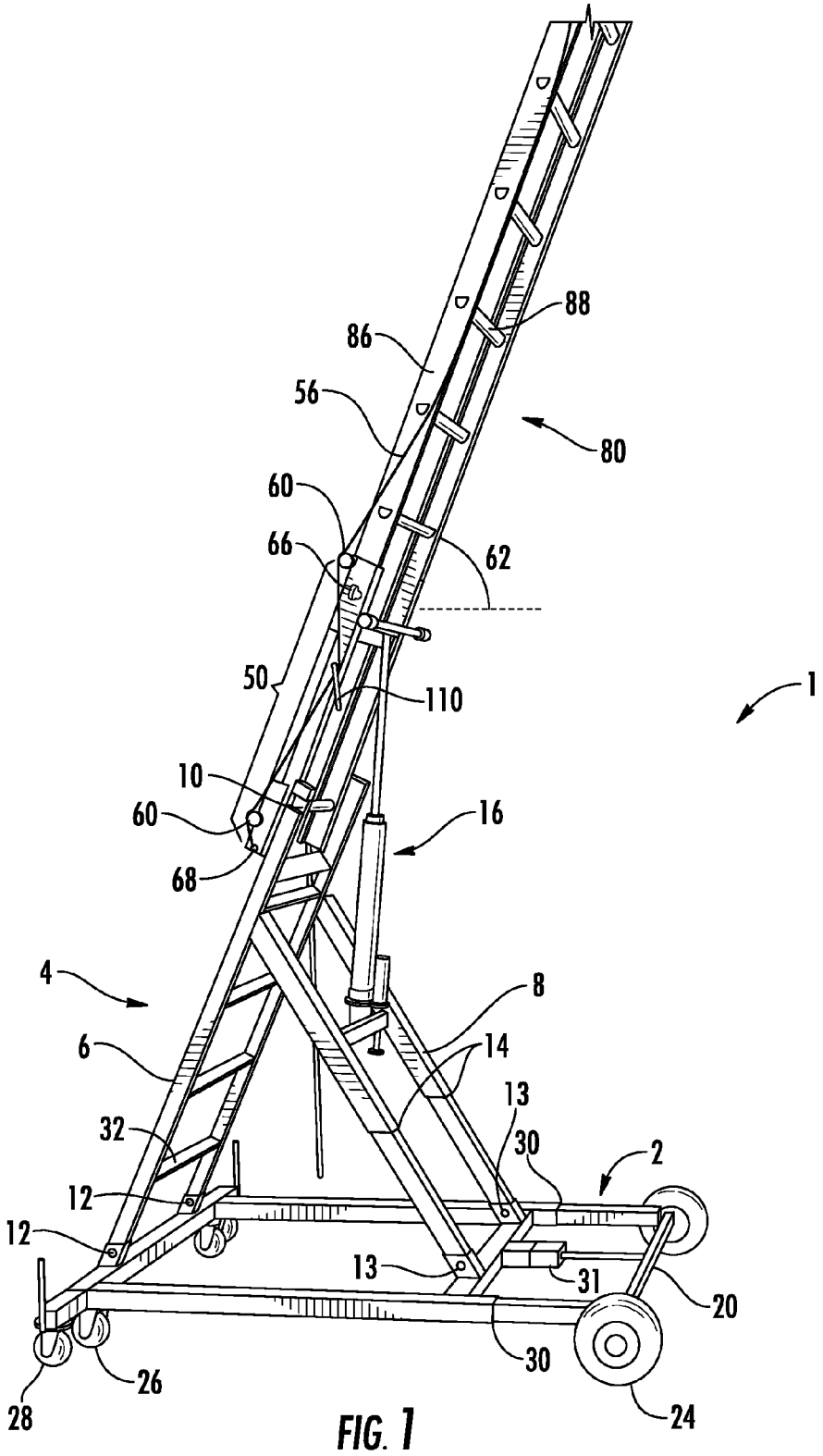
FIG. 1 illustrates a side view of an embodiment of the adjustable ladder support mechanism.

Reference will now be made in detail to the presently preferred embodiments of the invention, examples of which are illustrated in the accompanying drawings. Throughout the following detailed description, the same reference numerals refer to the same elements in all figures.

FIG. 1 illustrates a side view of an embodiment of the adjustable ladder support mechanism. The adjustable ladder support mechanism 1 is shown, including its two main components of the base 2 and tower 4. The exemplary embodiment of the tower 4 has two legs, a first tower leg 6 and a second tower leg 8. The first tower leg 6 is shown as extending above the point at which it meets the second tower leg 8, terminating at the ladder hinge 10. Ladder hinge 10 connects the tower 4 to the ladder gripping mechanism 50.

The tower 6 is shown connecting to the base 2 through optional hinges, specifically the first tower hinge 12 and the second tower hinge 13. First tower hinge 12 and second tower hinge 13 are needed when the inclination sliding joint 14 is present. Inclination sliding joint 14 is any type of joint that allows the length of the second tower leg 8 to be altered. Inclination sliding joint 14 is shown as a slip joint, allowing the lower portion of second tower leg 8 to slide within the upper portion of second tower leg 8. The position is then fixed using any number of known methods, including spring pins, bolts, etc.

The combination of the first tower hinge 12, second tower hinge 13, and inclination sliding joint 14 allows the inclination of the legs to be modified. Optionally, first tower leg 8 also incorporates a sliding joint (not shown).

The adjustable ladder support mechanism 1 can be used with extension ladders of great height, making tipping an issue. The base 2 of the adjustable ladder support mechanism 1 is equipped with multiple outriggers to increase stability before use. This includes front outriggers 20 and rear outriggers 26/28. Front outriggers 20 are shown as increasing the length of the base 2, although it is anticipated that front outriggers 20 can also be used to extend the width. Front outriggers are shown as contacting the ground through front wheels 24.

Front outriggers 20 can be extended using extension linear actuator 31, which increases the length of the base through the extension sliding joint 30. Extension sliding joint 30 is any type of joint that allows the length of the base 2 to be altered. Extension sliding joint 30 is shown as a slip joint, allowing one portion of the base 2 to slide into another portion of the base 2. The position is then fixed using any number of known methods, including spring pins, bolts, etc.

Rear outriggers 26/28 are shown extending the width of the base 2, although it is anticipated that rear outriggers 26/28 can also be used to extend the width. Rear outriggers are shown with two sets of wheels, a first set of rear wheels 26 that are at a fixed position on the base, and a second set as part of the outrigger foot 28. Outrigger foot 28 can be wheels, as shown in the exemplary embodiment, or a non-rolling end, such as a foot or pad. The wheels can be locking or non-locking.

The exemplary embodiment is shown with steps 32 that allow an operator to climb to the ladder.

Figure 4:
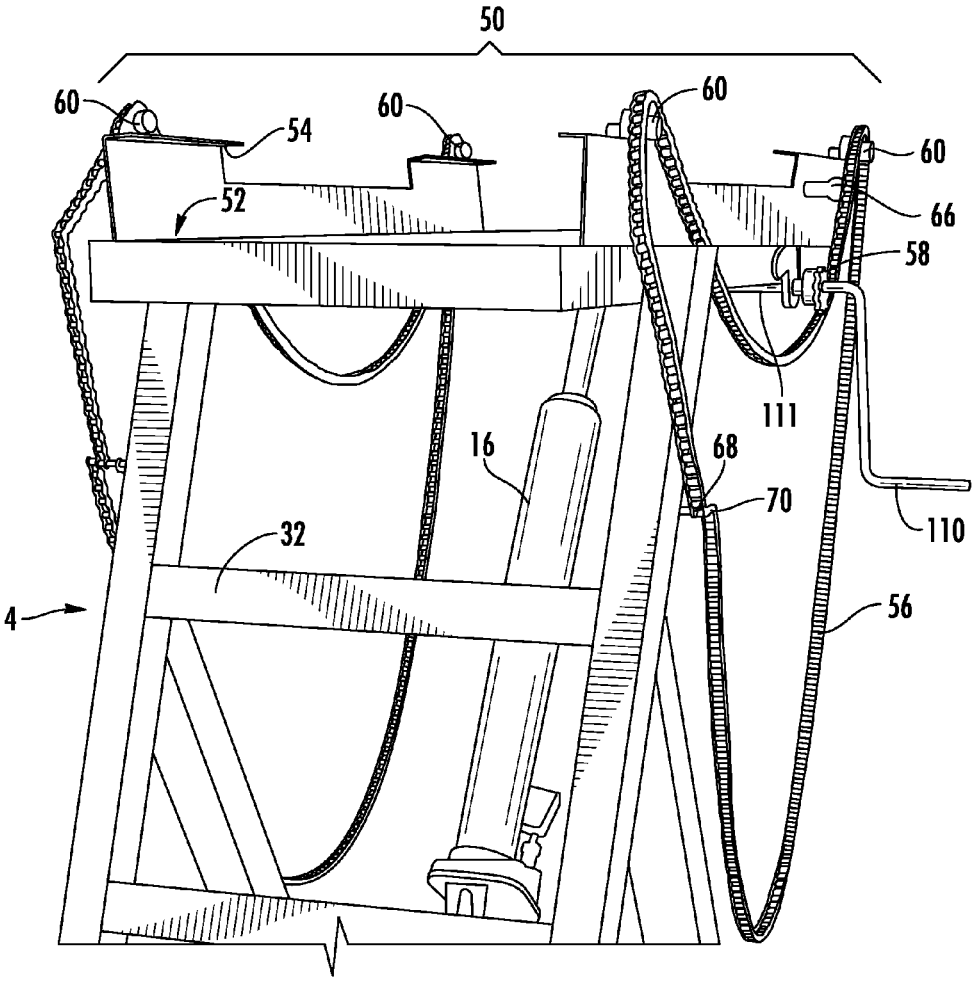
FIG. 4 illustrates a close-up of the section of the adjustable ladder support mechanism that interfaces with the extension ladder

Moving to the top of the tower 4, ladder gripping mechanism 50 is shown (for clarity, shown in FIG. 4 without the ladder). The ladder hinge 10 and ladder inclination linear actuator 16 work in combination to allow the ladder gripping mechanism 50 to alter the inclination angle 62 of the extension ladder 80.

Figure 2:
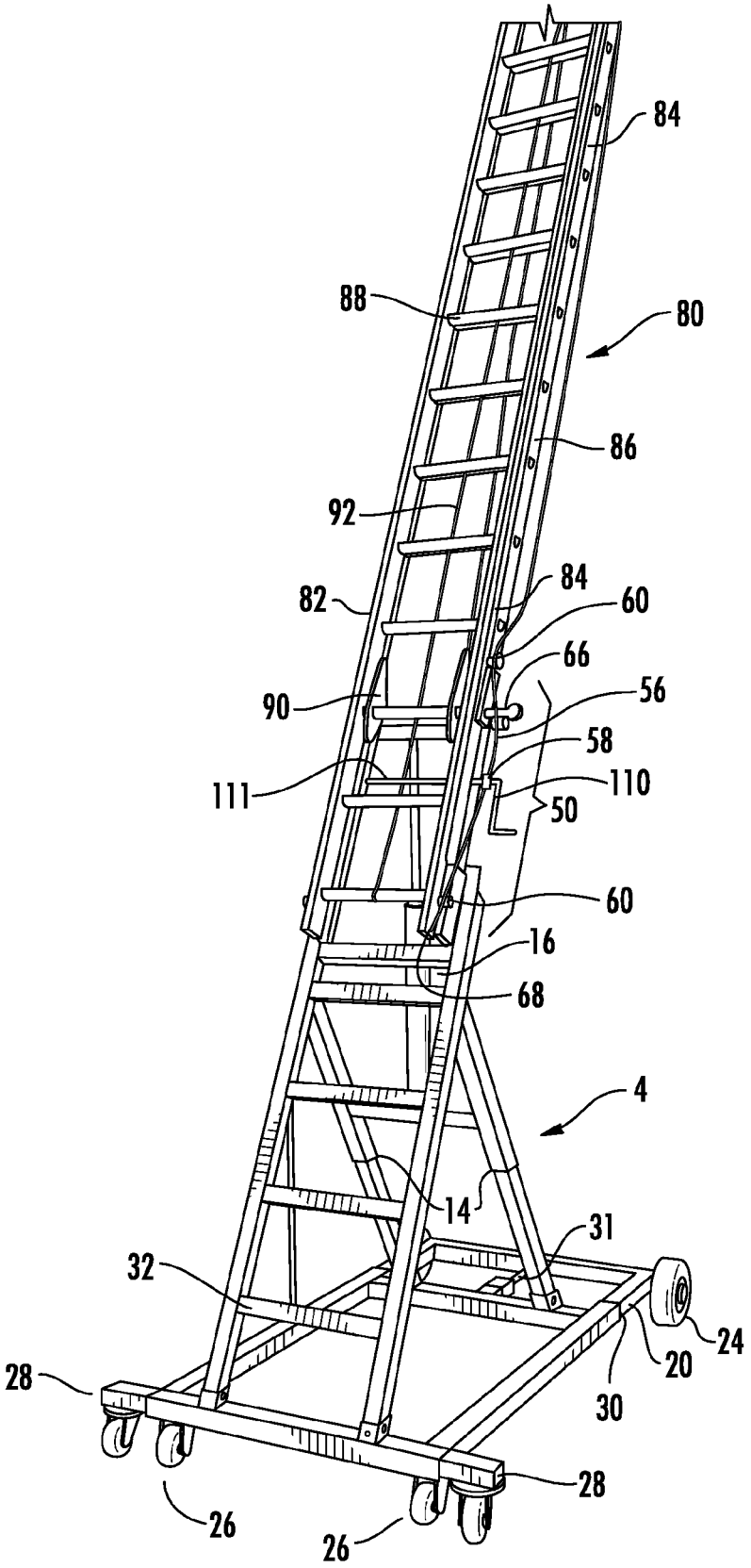
FIG. 2 illustrates an isometric view of an embodiment of the adjustable ladder support mechanism

Referring to FIG. 2, an isometric view of an embodiment of the adjustable ladder support mechanism 1 is shown. Extension ladder 80 is shown, specifically the base section 84 and fly section 82. Extension ladder 80 includes side rails 86, which connect rungs 88.

The locking mechanism between the fly section 82 and base section 84 is the standard rung lock 90 that is common to extension ladders. Furthermore, the rope and pulley system 92 common to extension ladders, used to extend the fly section 82 of the ladder 80 while at the base of the ladder 80, remains operational.

Figure 3:
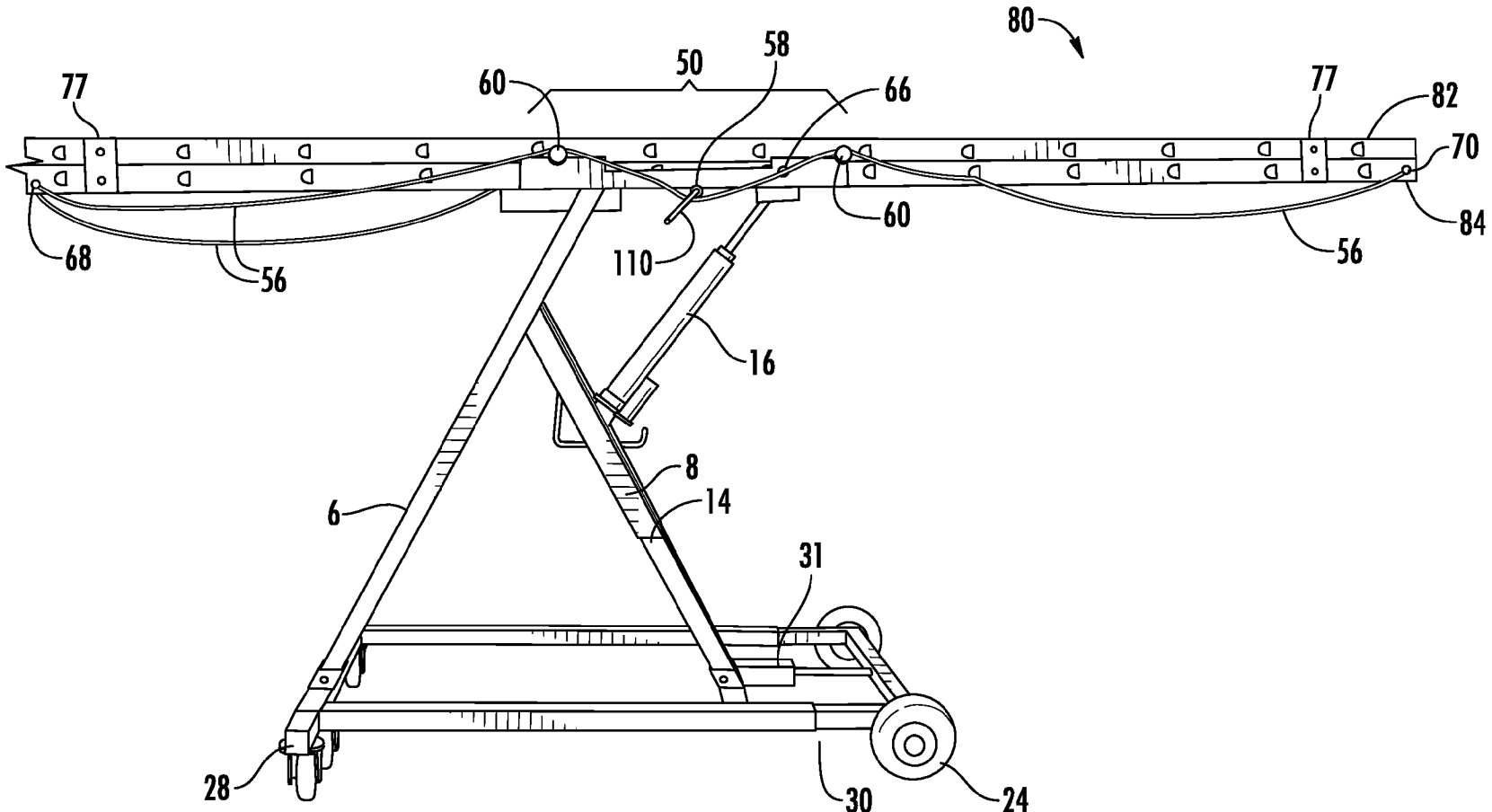
FIG. 3 illustrates a side view of an embodiment of the adjustable ladder support mechanism, with the support in a horizontal position.

Referring to FIG. 3, a side view of an embodiment of the adjustable ladder support mechanism, with the support in a horizontal position is shown. The adjustable ladder support mechanism 1 has the ability to hold the ladder in a horizontal position for use as scaffolding. Or, as shown in FIG. 3, to hold the extension ladder at an inclination angle 62 (see FIG. 1) of zero degrees. The inclination linear actuator 16 operates to fix the inclination of the ladder gripping mechanism 50, and the legs 6/8 of the tower 2 optionally include vertical adjustability to support changes in the elevation of the extension ladder 80.

Optional ladder plates 77 are shown affixing the fly section 82 of the extension ladder to the base section 84.

Referring to FIG. 4, a close-up of ladder gripping mechanism 50 is shown. The base section 84 of the extension ladder 80 is held by the ladder gripping mechanism 50. The base section is held between the lower ladder rest surface 52 and the upper ladder rest surface 54. Ladder pin 66 connects the ladder gripping mechanism 50 to the base section 84 of the extension ladder 80 by penetrating a hole created in the sidewall 86 by a rung 88.

Drive chain 56 is operated by drive gear 58, in turn rotated by crank 110 on axle 111. Drive chain 56 is supported by carrier gears 60. Axle 111 also rotates an additional drive gear (not shown) on the opposite side of the ladder gripping mechanism 50.

The drive chain 56 has two ends, a chain proximal end 68 and a chain distal end 70. Chain proximal end 68 is affixed to the proximal end of the base section 84 of the extension ladder 80. The ladder pin 66 is pulled to release the base section 84 of the extension ladder 80, and then the crank 110 is turned to reduce the length of chain between the chain proximal end 68 and the crank 110, acting to pull the proximal end 68 of the drive chain 56, thus raising the extension ladder 80. When the extension ladder 80 is in the desired location the ladder pin 66 is reinserted.

Figure 5:
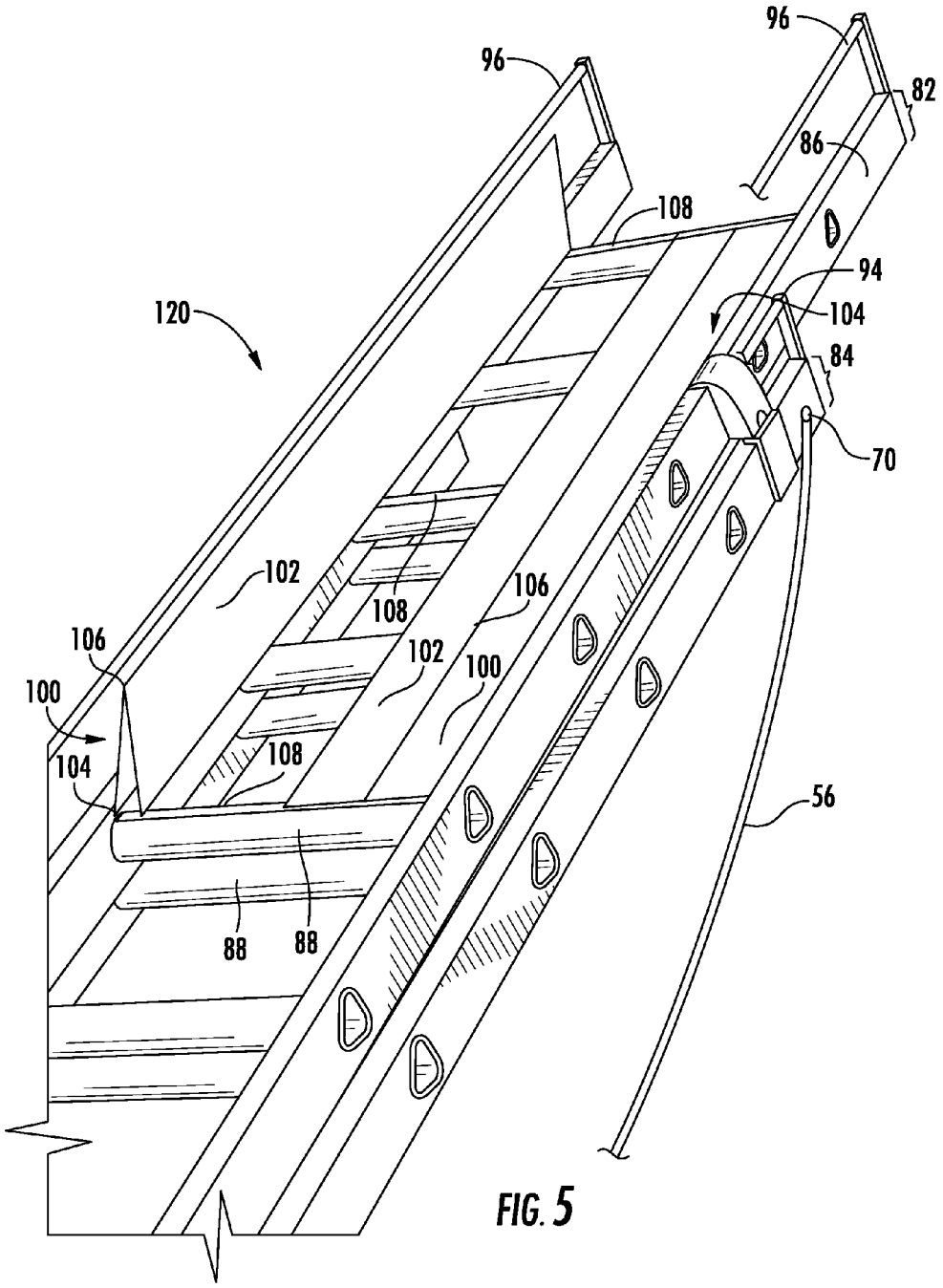
FIG. 5 illustrates a view of the optional folding covers for the ladder rungs.

Referring to FIG. 5, a view of the optional folding rung covers 120 for the ladder rungs is shown.

The exemplary folding rung covers 120 include an inner plate 100 connected to the side rail 86 by an inner hinge 104, and to the outer plate 102 by an intermediate hinge 106. The hinges 104/106 are any type of hinge, but likely to be a type of continuous hinge, commonly known as a piano hinge.

The inner plate 102 is held in alignment by interfacing with one or more tracks 108 mounted on, or intrinsic to, rungs 88.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An apparatus to support and elevate an extension ladder, comprising:

a. a base;

b. an A-shaped tower consisting of:

(i) two pairs of legs attached to the base; and (ii) the two pairs of legs meeting at a peak;

c. a ladder gripping mechanism consisting of:

i. an extension ladder interface with multiple C-shaped sections to cradle the extension ladder;

ii. a hinge;

iii. the hinge directly connecting the ladder gripping mechanism to the A-shaped tower; and iv. a ladder pin to prevent the extension ladder from sliding relative to the ladder gripping mechanism;

d. a linear actuator connected to the A-shaped tower and the ladder gripping mechanism, whereby the linear actuator controls an angle between the A-shaped tower and the ladder gripping mechanism e. a chain drive with a hand crank and a plurality of carrier gears;

f. a chain interfacing with the hand crank and the plurality of carrier gears;

g. the chain having two ends, each end for attachment to an end of the extension ladder, h. whereby motion of the hand crank causes the standard extension ladder to move with respect to the ladder gripping mechanism.

2. The apparatus of claim 1, wherein the ladder gripping mechanism interfaces with the extension ladder at a sliding connection.

3. The apparatus claim 1, wherein one pair, of the two pairs of legs, is of variable length.

4. The apparatus of claim 1 further comprising outriggers that are extendable and retractable.

5. The apparatus of claim 1, wherein:

a. the base is comprised of a fixed section and an extendable section interfaced by a sliding joint;

b. wherein the fixed section and extendable section can be moved relative to each other through use of an extension linear actuator; and c. wherein the extendable section allows for expansion of the base into a larger size, increasing stability.

6. An adjustable ladder support mechanism comprising;

a. a hand-portable base having a rectangular shape with four corners;

b. the hand-portable base having a wheel at each of the four corners;

c. an A-shaped tower;

d. the A-shaped tower directly connected to the hand-portable base;

e. a ladder gripping mechanism;

f. the ladder gripping mechanism directly connected to the A-shaped tower by a hinge, the ladder gripping mechanism of a size and shape to interface with a base portion of an extension ladder;

g. a linear actuator;

h. the linear actuator connecting the A-shaped tower to the ladder gripping mechanism;

i. the linear actuator acting in combination with the hinge, thereby allowing a user to increase and decrease an inclination angle of the extension ladder; and k. a chain drive;

l. a hand crank interfaced to a chain and to the ladder gripping mechanism;

m. the chain supported by a plurality of carrier gears;

n. the chain connected to the extension ladder and to the ladder gripping mechanism;

o. whereby motion of the hand crank causes the extension ladder to move with respect to the ladder gripping mechanism.

7. The adjustable ladder support mechanism of claim 6, the extension ladder including rungs, the adjustable ladder support mechanism further comprising:

a. one or more hinged ladder rung covers, each of the one or more hinged ladder rung covers in contact with two or more ladder rungs for stability;

b. the hinged ladder rung covers having a first position folded against the extension ladder, exposing the rungs of the extension ladder;

c. and a second position unfolded and against the rungs of the extension ladder, providing a walking space.

8. The adjustable ladder support mechanism of claim 6, wherein the ladder gripping mechanism interfaces with the extension ladder at a sliding interface.

9. The adjustable ladder support mechanism of claim 6 further comprising outriggers that are extendable and retractable.

10. The adjustable ladder support mechanism of claim 6 wherein the extension ladder is removable.

11. A portable extension ladder support, designed to attach to an extension ladder, the portable extension ladder support comprising;

a. a mobile base able to be moved by hand;

b. a first pair of tower legs attached to the mobile base;

c. a second pair of tower legs attached to the mobile base;

d. an A-shaped tower formed by the first pair of tower legs and the second pair of tower legs;

e. a ladder gripping mechanism with two C-shaped sections for interfacing with a standard extension ladder;

f. the ladder gripping mechanism directly hingedly connected to the A-shaped tower;

g. an inclination angle being the angle between horizontal and the ladder gripping mechanism;

h. an actuator for adjusting inclination angle measured between the ladder gripping mechanism and the A-shaped tower i. a chain drive with a hand crank and a plurality of carrier gears;

j. a chain interfacing with the hand crank and plurality of carrier gears, k. the chain having two ends, each end for attachment to opposing ends of the extension ladder;

l. whereby motion of the hand crank causes the standard extension ladder to move with respect to the ladder gripping mechanism.

12. The portable extension ladder support of claim 11, wherein the second pair of tower legs is of adjustable length, resulting in the A-shaped tower having fully adjustable height.

13. The portable extension ladder support of claim 11, wherein the position of the extension ladder with respect to the ladder gripping mechanism is maintained by a ladder pin, and the ladder pin must be released to unlock the household extension ladder prior to use of the chain drive.

14. The portable extension ladder support of claim 11, wherein:

a. the mobile base is comprised of a fixed section and an extendable section interfaced by a sliding joint;

b. wherein the fixed section and extendable section can be moved relative to each other through use of an extension linear actuator; and c. wherein the extendable section allows for expansion of the mobile base into a larger size, increasing stability.

* * * * *